US009088102B2

(12) United States Patent
Cai et al.

(10) Patent No.: US 9,088,102 B2
(45) Date of Patent: Jul. 21, 2015

(54) ANTI-LOOSE SOCKET AND PULL-OUT LOCKING MECHANISM THEREOF

(75) Inventors: Yingfeng Cai, Cixi (CN); Zhiwei Li, Cixi (CN)

(73) Assignee: BULL GROUP CO., LTD, Cixi (CN)

( * ) Notice: Subject to any disclaimer, the term of this patent is extended or adjusted under 35 U.S.C. 154(b) by 14 days.

(21) Appl. No.: 14/002,362

(22) PCT Filed: Feb. 28, 2012

(86) PCT No.: PCT/CN2012/071711
§ 371 (c)(1),
(2), (4) Date: Aug. 30, 2013

(87) PCT Pub. No.: WO2012/116626
PCT Pub. Date: Sep. 7, 2012

(65) Prior Publication Data

US 2013/0337675 A1 Dec. 19, 2013

(30) Foreign Application Priority Data

Mar. 1, 2011 (CN) ..... 2011 1 0049780

(51) Int. Cl.
*H01R 13/20* (2006.01)
*H01R 13/639* (2006.01)
(Continued)

(52) U.S. Cl.
CPC ..... *H01R 13/639* (2013.01); *H01R 13/6395* (2013.01); *H01R 13/635* (2013.01); *H01R 24/76* (2013.01); *H01R 2103/00* (2013.01)

(58) Field of Classification Search
CPC ..... H01R 13/20; H01R 13/6275
USPC ..... 439/345, 346, 848
See application file for complete search history.

(56) References Cited

U.S. PATENT DOCUMENTS 5,129,836 A * 7/1992 Ursich ..... 439/346
5,393,239 A 2/1995 Ursich
(Continued)

FOREIGN PATENT DOCUMENTS

CN 102117992 A 7/2011
CN 201927843 U 8/2011
JP S62-084178 U 5/1987

OTHER PUBLICATIONS

Search report and office action by SIPO.
Search report by ISA.
International Search Report and Written Opinion for PCT/CN2012/071711.
(Continued)

*Primary Examiner* — Abdullah Riyami
*Assistant Examiner* — Nelson R Burgos-Guntin
(74) *Attorney, Agent, or Firm* — Kilpatrick Townsend & Stockton LLP

(57) ABSTRACT

The present invention relates to an anti-loose socket and a pull-out locking mechanism thereof, wherein inside the anti-loose socket, there are a pull-out locking mechanism composed of a bevelled sleeve (15) and two cylinders (16) arranged in a symmetrical manner at two sides within the bevelled sleeve; an inside longitudinal section of the bevelled sleeve has a cone angle in an umbrella shape, the middle portion of the bevelled sleeve allows a plug pin (61) to pass through; the cylinder is mounted on a floating block (14) movable up and down, and can move up and down along the inside conical surface of the bevelled sleeve by the floating block. When the plug (6) is pulled out upwards, the cylinder moves upwards, however due to the limiting action of the bevel surface, the cylinders stick to the two bevel surfaces more and more tightly.

8 Claims, 3 Drawing Sheets

(51) Int. Cl.

| | |
|---|---|
| *H01R 103/00* | (2006.01) |
| *H01R 13/635* | (2006.01) |
| *H01R 24/76* | (2011.01) |

(56) References Cited

U.S. PATENT DOCUMENTS

| | | | | |
|---|---|---|---|---|
| 5,551,884 | A | 9/1996 | Burkhart, Sr. | |
| 6,875,040 | B1 * | 4/2005 | O'Keefe et al. | 439/346 |
| 2002/0048987 | A1 * | 4/2002 | Ursich | 439/346 |
| 2010/0197156 | A1 | 8/2010 | Chen | |

OTHER PUBLICATIONS

Supplementary European Search Report issued Jul. 15, 2014 for counterpart European Application 12751767.0.

First Office Action issued Jun. 20, 2013 for counterpart Chinese Application 201210047885.1.

Second Office Action issued Apr. 1, 2014 for counterpart Chinese Application 201210047885.1.

Office Action dated Feb. 12, 2015 in a corresponding Japanese application.

* cited by examiner

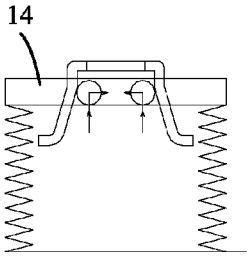
Fig. 3.1
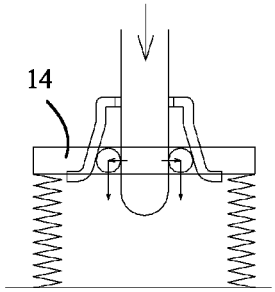
Fig. 3.2
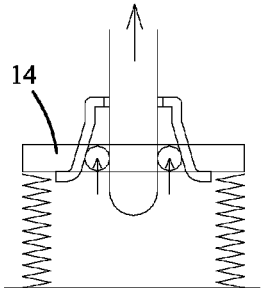
Fig. 3.3
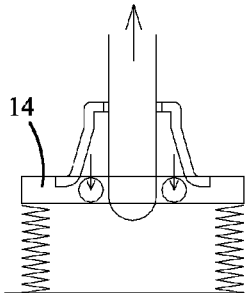
Fig. 3.4
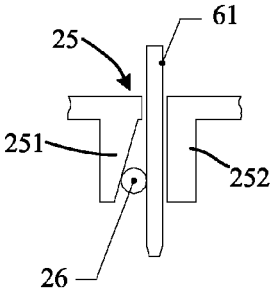
Fig. 4
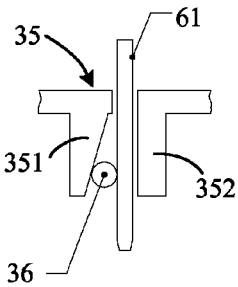
Fig. 5
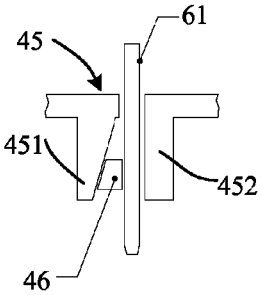
Fig. 6

ANTI-LOOSE SOCKET AND PULL-OUT LOCKING MECHANISM THEREOF

The present application is the US national phase of International Application No. PCT/CN2012/071711 filed on Feb. 28, 2012, which claims the benefit of priority to Chinese Invention Patent Application CN201110049780.5, filed Mar. 1, 2011, this application being incorporated herein by reference.

TECHNICAL FIELD

The present invention relates to a socket for preventing a plug from being pulled out.

BACKGROUND ART

Common sockets are various, wherein the connection ways between the plug and the socket are mainly insert in structures. The anti-loose sockets in prior art are as follows:

One. An anti-loose socket in Application 200820192348.5 comprises: a socket (1), a boss (2) is mounted on the bottom of the socket (1), oblique wedged slots (3) are provided at two sides of the boss (2), pulleys on the lower ends of the two fixed arms (4),(5) slide within the wedged slots (3), hook-shaped upper ends of the two fixed arms (4),(5) pass through the holes in the upper lid of the socket (1) and out of the socket (1), a connecting rod (6) is connected to the two fixed arms (4),(5) via rotating shafts (7),(8), respectively, and mounted below the inserting hole composed of elastic metal copper sheet; a supporting rod (9) passes through one end of the connecting rod (6) and is fixed on the boss (2), a spring (10) on the supporting rod (9) is connected to the connecting rod (6) on one end, and is connected to the boss (2) on the other end. Its advantage is: the plug can be inserted in and pulled out easily and securely, the plug does not easily drop off, its use is safe and convenient, ensuring the normal use and power utilization safety of the electrical appliance.

Two. An anti-loose socket which can fix plug wirings in Application 200820165244.5 comprises socket components, an inserting hole is provided in the middle portion of the socket, two supporting rods are provided below the inserting hole, a movable fixture is mounted on the top end of the supporting rod. Its advantages are: it is simple in structure, convenient and safe to use; and it can fix wirings, so as to prevent the plug from being pulled out.

Three. An anti-loose safety socket in Application 200810116688.4 comprises an insulated housing having several inserting holes, an electrode is provided in each inserting hole, wherein: at least one one way interference member is disposed within the insulated housing, which prevents the inserting of the plug from being influenced, however, the pulling out of the plug will be interference. This invention conclusively achieves the invention objective of simple structure and convenient operation.

The three types of anti-loose sockets utilize a torsion fixed structure, a supporting rod-movable fixture fixed structure, and a transversal interference fixed structure; the three fixed structures each has its own character, but is not so convenient during use. The current problem in the art of anti-loose socket is that, the plug after being inserted into the socket can be automatically secured and locked, and will not loose under a general external force, the plug can be pulled out of the socket only after the secured position has been opened by a particular structure.

DISCLOSURE OF THE INVENTION

An objective of the present invention is to provide a anti-loose socket, so as to solve the problem that the plug after being inserted into the socket is easily pulled off, so that the plug after being inserted into the socket can be automatically secured and locked, and will not loose under a general external force.

Another objective of the present invention is to provide a pull-out locking mechanism for an anti-loose socket.

These objectives of the present invention can be achieved by the following technical solutions:

An anti-loose socket, comprising a pull-out locking mechanism composed of a bevelled sleeve and a cylinder within the bevelled sleeve; wherein an inside longitudinal section of the bevelled sleeve has a cone angle in an umbrella shape, a middle portion of the bevelled sleeve allows a pin to pass through; and wherein the cylinder is mounted on a floating block movable up and down, and can move up and down along the inside conical surface of the bevelled sleeve by the floating block.

The anti-loose socket, wherein a housing is composed of an upper lid body and a lower lid body snapped with each other, and the pull-out locking mechanism is mounted below an insertion hole of the upper lid body and above an inserting bushing, within the housing.

The anti-loose socket, wherein in the pull-out locking mechanism, two cylinders are arranged in a symmetrical manner at two sides within the bevelled sleeve.

The anti-loose socket, wherein the pull-out locking mechanism is at least one.

The anti-loose socket, wherein the cylinder is replaced by a wedge or sphere.

An operating lever is mounted within the housing, one end of the operating lever is mounted on the housing by a hinge axis, a socket button outside of the housing is mounted on the other end of the operating lever, a spring or elastic body is mounted below the floating block, and the floating block is movably articulated with the middle portion of the operating lever.

The pull-out locking mechanism, the inserting bushing, the spring or elastic body, and the floating block are mounted within a module base and a small panel having various inserting holes snapped with each other, so as to compose an anti-loose functional module.

A bracket is disposed between the bevelled sleeve and the inserting bushing, for securing the bevelled sleeve and the inserting bushing.

The pull-out locking mechanism is included in the anti-loose functional module, the anti-loose functional module further comprises a module base, and an upper small panel, the small panel and the module base are snapped with each other, an inserting bushing is mounted within the module base, for clipping the plug, the floating block is disposed between the small panel and the module base, a spring is mounted below the floating block; the bevelled sleeve for the plug to pass through is mounted at an inserting hole position corresponding to the small panel, an operating lever is mounted within the anti-loose socket, the middle portion of the operating lever is connected to the floating block, the floating block provides a tension force for the operating lever by means of the spring force of the spring, so that the operating lever closely fits the module base, and one of the two ends of the operating lever can contact with the module base to form a fulcrum, for rotating the other end under an external force.

When the plug is inserted, the pin of the plug and the bevel surface of the bevelled sleeve compose an acute-angled region, the metal cylinder within the acute-angled region closely fits the bevel surface and the pin surface due to the action of the spring, when the plug is pulled out upwards, the metal cylinder moves upwards due to the action of a friction force and an elastic force, however due to the action of the bevel surface, the metal cylinders stick to the two bevel surfaces more and more tightly, so as to form a self-locking, such that the plug cannot be pulled out or cannot be easily pulled out; when the cylinders drop down, the plug can be easily pulled out.

A pull-out locking mechanism for an anti-loose socket, wherein it is composed of a bevelled sleeve having a cone angle in a longitudinal section and a cylinder disposed within the bevelled sleeve.

The pull-out locking mechanism for an anti-loose socket, wherein the cylinders are arranged in a symmetrical manner at two sides within the bevelled sleeve.

The pull-out locking mechanism for an anti-loose socket, wherein at least one side portion within the bevelled sleeve has the cone angle and is provided with the cylinder.

The pull-out locking mechanism for an anti-loose socket, wherein the cylinder is mounted on a floating block movable up and down.

The pull-out locking mechanism for an anti-loose socket, wherein the cylinder is replaced by a wedge or sphere.

The pull-out locking mechanism for an anti-loose socket, wherein the cylinder is replaced by a friction member.

BRIEF DESCRIPTION OF THE DRAWINGS

The particular feature, performance of the present invention can be further given from the following embodiments and figures.

FIG. 3.1 is a motion schematic view of a cylinder in an initial state;

FIG. 3.2 is a motion schematic view of the cylinder in an inserting state;

FIG. 3.3 is a motion schematic view of the cylinder in a locking state;

FIG. 3.4 is a motion schematic view of the cylinder in a pull-out state;

FIG. 4 is a schematic view of a pull-out locking mechanism according to another embodiment of the present invention;

FIG. 5 is a schematic view of a pull-out locking mechanism according to another embodiment of the present invention;

FIG. 6 is a schematic view of a pull-out locking mechanism according to another embodiment of the present invention;

1. anti-loose functional module; 2. upper lid body; 3. lower lid body; 4. operating lever; 5. socket button; 6. plug; 11. small panel; 12. module base; 13. spring; 14. floating block; 15. bevelled sleeve; 16. metal cylinder; 17. inserting bushing; 18. bracket.

BEST MODE FOR CARRYING OUT THE INVENTION

Figure 1:
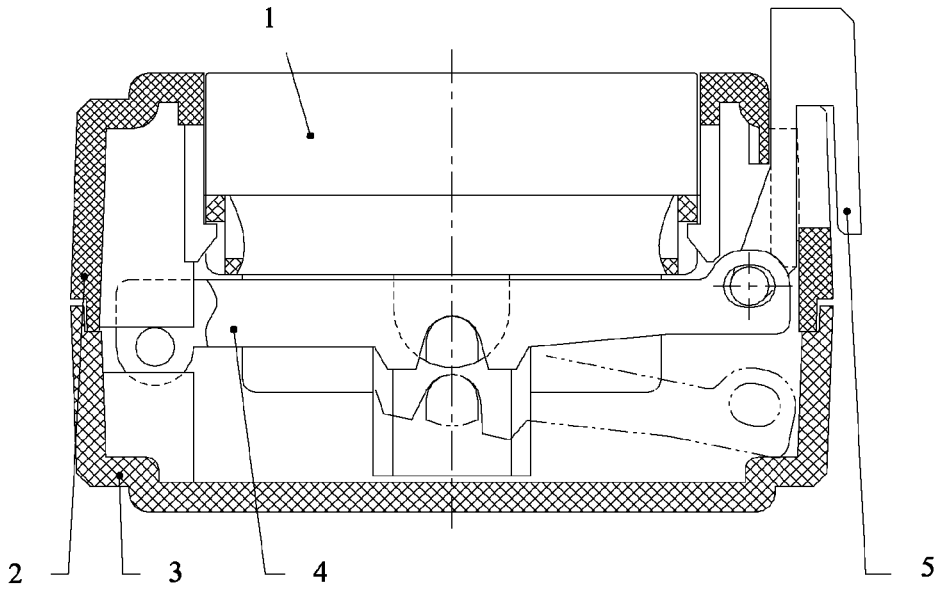
FIG. 1 is a schematic view of a mounted structure where a anti-loose functional module and an operating mechanism of the anti-loose socket are located within the socket according to an embodiment.
Figure 2:
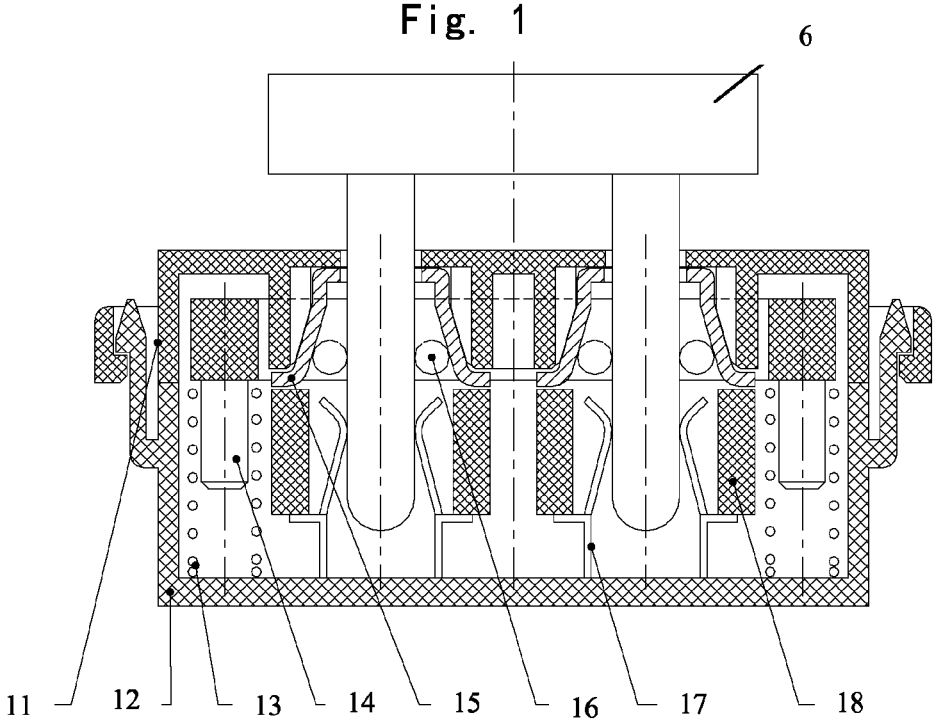
FIG. 2 is an inner structural view of the anti-loose functional module according to an embodiment.

As shown in FIGS. 1 and 2, an anti-loose socket comprises an upper lid body 2 and a lower lid body 3 snapped with each other, wherein a plurality of anti-loose functional modules 1 are mounted within the space closed by the upper lid body 2 and the lower lid body 3, the anti-loose functional module 1 comprises a module base 12 and a small panel 11 thereon, an inserting bushing 17 is mounted within the module base 12, for clipping the plug 6, the upper portion of the inserting bushing 17 is secured by a pushing-down bracket 18, a floating block 14 is disposed between the small panel 11 and the module base 12, a spring 13 is mounted below the floating block 14; a bevelled sleeve 15 for the plug to pass through is mounted at an inserting hole position corresponding to the small panel 11, an upper portion of the bevelled sleeve 15 closely fits a bevelled rib of the small panel 11, and an lower portion of the bevelled sleeve 15 is supported by the bracket 18; a longitudinal section of the bevelled sleeve 15 has a cone angle in an umbrella shape, two metal cylinders 16 are arranged in a symmetrical manner at two sides within the bevelled sleeve 15, so as to compose a pull-out locking mechanism; the metal cylinder 16 is mounted on the floating block 14, and can move up and down along with the floating block 14; an operating lever 4 is mounted within the socket, the middle portion of the operating lever 4 is movably articulated with the floating block 14, one end of the operating lever 4 is mounted on the upper lid body 2 or the lower lid body 3 by a hinge axis, a socket button 5 is mounted on the other end of the operating lever 4; the floating block 14 can move up and down by the spring 13 and the floating block 14.

When the plug is inserted, the pin of the plug 6 and the bevel surface of the bevelled sleeve 15 compose an acute-angled region, the metal cylinder 16 within the acute-angled region closely fits the bevel surface and the pin surface due to the action of the spring 13, when the plug 6 is pulled out upwards, the metal cylinder 16 moves upwards due to the action of a friction force and an elastic force, however due to the action of the bevel surface, the metal cylinders 16 stick to the bevel surfaces on both sides more and more tightly, so as to form a self-locking, such that the plug cannot be pulled out or cannot be easily pulled out.

Figure 7:
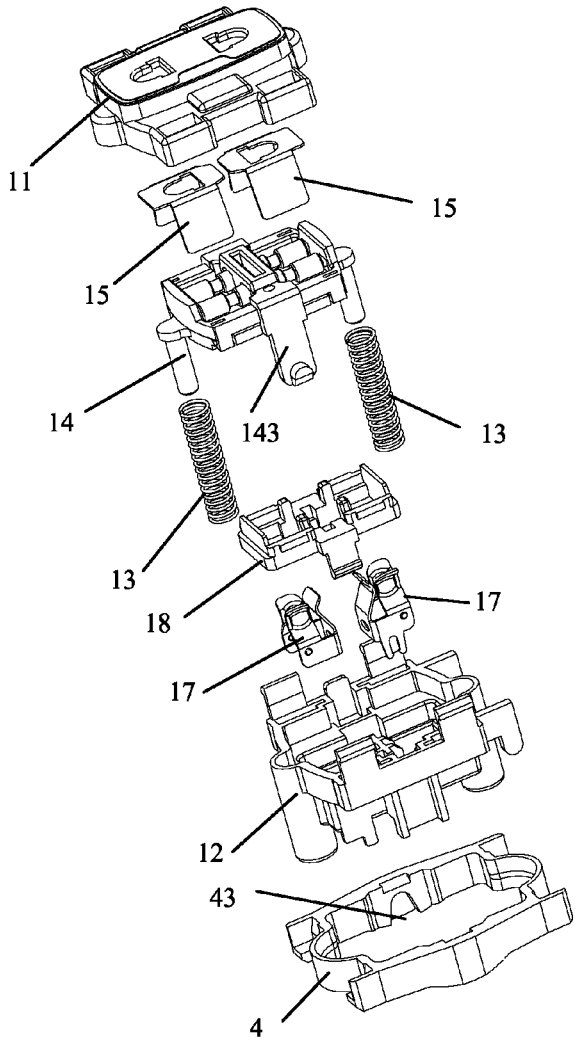
FIG. 7 is a exploded view of the embodiment as shown in FIG. 2.
Figure 8:
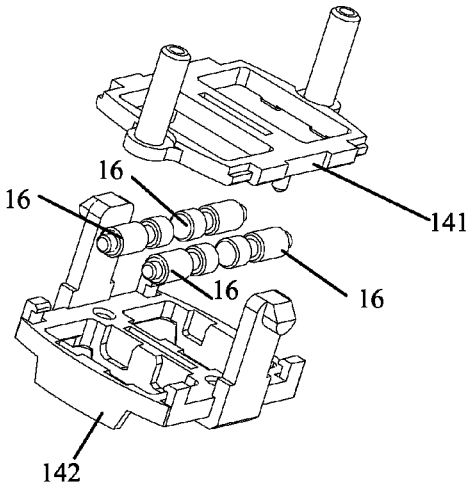
FIG. 8 is a exploded view of the floating block and the cylinder as shown in FIG. 7.
Figure 9:
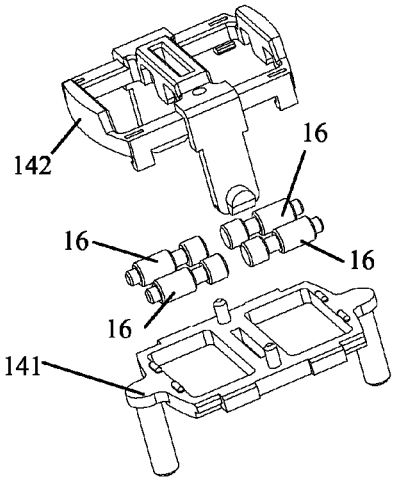
FIG. 9 is a exploded view of the floating block and the cylinder as shown in FIG. 7.

The embodiment of FIG. 2 can be further understood with reference to FIGS. 7-9. The floating block 14 is formed by two snapping plates 141, 142, the cylinder 16 is mounted between the two snapping plates 141, 142 of the floating block 14.

With reference to FIGS. 7-9, the operating lever 4 is an annular member, snapping holes 43 are disposed in the middle portions of the opposite inner sidewalls, the floating block 14 has two connecting arms 143 corresponding to the two snapping holes, a snapping boss is disposed at the end of the connecting arm 143, the floating block 14 and the operating lever 4 are connected together by the snapping action of the snapping boss and the snapping hole. The operating lever 4 is located at the bottom of the module base 12, due to the connection of the connecting arm 143 and the operating lever 4, the connecting arm 143 provides a tension force for the operating lever 4 under the force of the spring 13, so that the operating lever 4 closely fits the module base 12, and is stably mounted on the anti-loose functional module 1. Whether a downwards pushing force is applied from the left or right end of the operating lever 4, the right or left end of the operating lever 4 will contact with the module base 12 to form a fulcrum, the middle portion of the operating lever 4 brings the floating block 14 to move downwards, so that the cylinder 16 moves downwards, so as to unlock.

FIGS. 7-9 show a best embodiment of the operating lever 4. There are other implementment ways for the operating lever 4 in the other embodiments of the present invention, for example, the operating lever 4 is only a rod member, the operating lever 4 can also dispose at the inner side of the anti-loose functional module, and the connecting way between the operating lever 4 and the floating block 14 can also be connecting way other than snapping connection.

The operating process comprises:

An initial state as shown in FIG. 3.1: When the plug has not been inserted into the inserting hole, the floating block 14 brings the metal cylinders 16 to move upwards under the action of the spring force, at the same time, the metal cylinders 16 move inwards due to the limiting action of the bevel surface, and at this time, the metal cylinders 16 are located at the highest position and the gap between the two cylinders is smaller than the width of the pin;

An inserting state as shown in FIG. 3.2: When the plug has been inserted into the inserting hole, the pin of the plug firstly contacts with the metal cylinder 16, then moves downwards along with the metal cylinder 16 against the spring force, at the same time, the two cylinders move outwards until the gap between the two cylinders is equal to the width of the pin, the metal cylinders 16 stop moving, the pin continues to move downwards, and to insert into the inserting bushing 17 of the socket, so as to form a electrical connection, and at this time, the metal cylinders 16 maintain contacting with the two beval surfaces all the time under the action of the spring force, being at a standby state;

A locking state as shown in FIG. 3.3: When the plug tends to be pulled out upwards, the metal cylinders 16 tend to move upwards under the action of the friction force and the spring force, however due to the action of the bevel surface, the cylinders 16 stick to the two bevel surfures more and more tightly, so as to form a self-locking, such that the plug cannot be pulled out or cannot be easily pulled out.

A pull-out state as shown in FIG. 3.4: When the plug needs to be pulled out, the socket button 5 is pushed, the floating block 14 moves downwards by the operating lever 4, so that the metal cylinders 16 disengage from the bevel surfaces and the pin, and at this time the plug can be pulled out normally.

The pull-out locking mechanism in the embodiment as shown in FIG. 4 comprises a bevelled sleeve 25 and a cylinder 26, wherein in the longitude section, the inner surface of one side portion 251 of the bevelled sleeve 25 is a bevel surface (which has a cone angle in an umbrella shape with respect to the pin 61 of the plug or with respect to the vertical reference line), the inner surface of the other side portion 252 is a straight surface. The pull-out locking mechanism in the embodiment as shown in FIG. 4 can directly replace the pull-out locking mechanism (the bevelled sleeve 15 and a metal cylinder 16) in the embodiment as shown in FIG. 1 to FIG. 3.4, so as to bring the technical effect of preventing the pin from being pulled out. The bevelled sleeve 25 can be a monolithic member, or can be a detached member, for example, its two side portions 251, 252 can be detached.

The pull-out locking mechanism in the embodiment as shown in FIG. 5 comprises a bevelled sleeve 35 and a sphere 36, wherein in the longitude section, the inner surface of one side portion 351 of the bevelled sleeve 35 is a bevel surface (which has a cone angle in an umbrella shape with respect to the pin 61 of the plug or with respect to the vertical reference line), the inner surface of the other side portion 352 is a straight surface. The pull-out locking mechanism in the embodiment as shown in FIG. 5 can directly replace the pull-out locking mechanism (the bevelled sleeve 15 and a metal cylinder 16) in the embodiment as shown in FIG. 1 to FIG. 3.4, so as to bring the technical effect of preventing the pin from being pulled out. The bevelled sleeve 35 can be a monolithic member, or can be a detached member, for example, its two side portions 351, 352 can be detached. The inner surface of the side portion 352 of the bevelled sleeve 35 can also be a bevel surface (which has a cone angle in an umbrella shape with respect to the pin 61 of the plug or with respect to the vertical reference line), and a sphere 36 is also disposed at the inner side of the side portion 352. In a preferable embodiment, the side portions 352, 351 are in a symmetrical structure, spheres 36 are disposed at the inner sides thereof respectively.

The pull-out locking mechanism in the embodiment as shown in FIG. 6 comprises a bevelled sleeve 45 and a wedge 46, wherein in the longitude section, the inner surface of one side portion 451 of the bevelled sleeve 45 is a bevel surface (which has a cone angle in an umbrella shape with respect to the pin 61 of the plug or with respect to the vertical reference line), the inner surface of the other side portion 452 is a straight surface. The wedge 46 is wedged within the bevel surface. The pull-out locking mechanism in the embodiment as shown in FIG. 6 can directly replace the pull-out locking mechanism (the bevelled sleeve 15 and a metal cylinder 16) in the embodiment as shown in FIG. 1 to FIG. 3.4, so as to bring the technical effect of preventing the pin from being pulled out. The bevelled sleeve 45 can be a monolithic member, or can be a detached member, for example, its two side portions 451, 452 can be detached. The inner surface of the side portion 452 of the bevelled sleeve 45 can also be a bevel surface (which has a cone angle in an umbrella shape with respect to the pin 61 of the plug or with respect to the vertical reference line), and a wedge 46 is also disposed at the inner side of the side portion 452. In a preferable embodiment, the side portions 452, 451 are in a symmetrical structure, wedges 46 are disposed at the inner sides thereof respectively.

In the embodiment of FIG. 2, the bevel surfaces inside of the bevelled sleeve 15 and the cylinders at their inner sides can be symmetrical or asymmetrical.

In the preceding embodiments, the bevelled sleeve refers to all the member which can provide a bevel surface or conical surface.

In the preceding embodiments, the cylinder, sphere or wedge is a friction member, which comprises various members being able to be in a friction engagement with the plug of the socket, wherein the friction member contacts with the bevel surface of the bevelled sleeve on one hand, and engages frictionally with the pin of the plug on the other hand, the equality member to the cylinder, sphere or wedge is other type of friction member, which can also bring the function of preventing the pin from being pulled out in the preceding embodiments.

In the preceding embodiments, the pull-out locking mechanism 1 can be only one or at least one corresponding to one anti-loose functional module 1, i.e., at least one inserting hole corresponds to one pull-out locking mechanism, for example, as shown in the embodiment of FIG. 2, FIG. 7 to FIG. 9, there can be only one pull-out locking mechanism.

In the preceding embodiments, besides being disposed at the outer side of the anti-loose functional module, the operating lever 4 can also be disposed at the inner side of the anti-loose functional module.

In the preceding embodiments, the spring 13 refers to an elastic body which functions through elasticity, comprising but not limited to a part made of spring steel, and a part made of other elastic material.

In the preceding embodiments, the cylinder can be made of metal, and can also be made of other hard material.

In the preceding embodiments, the pull-out locking mechanism is located between the small panel 11 and the inserting bushing 17, and actually not limited to this, can also be located below the inserting bushing 17.

In the preceding embodiments, due to the presence of the bevel surface or cone surface, the pin of the socket will be locked by friction as long as the bevelled sleeve or the pin of the socket does not appear an excessively large deformation, which applies to plug of any shape, and has good versatility.

The pull-out locking mechanism in the preceding embodiments is defined as a "pull-out locking mechanism of an anti-loose socket", however, it should be understood as not limited to be used in a socket, but can be used in the any other device and situation, so as to lock the pin.

The invention claimed is:

1. An anti-loose socket, comprising a pull-out locking mechanism composed of a bevelled sleeve and a cylinder within the bevelled sleeve; wherein an inside longitudinal section of the bevelled sleeve has a cone angle in an umbrella shape, a middle portion of the bevelled sleeve allows a pin to pass through; and wherein the cylinder is mounted on a floating block movable up and down, and can move up and down along the inside conical surface of the bevelled sleeve by the floating block; and the pull-out locking mechanism is mounted below an insertion hole and above an inserting bushing within a housing; an operating lever is mounted within the housing, one end of the operating lever is mounted on the housing by a hinge axis, a socket button outside of the housing is mounted on the other end of the operating lever, a spring or elastic body is mounted below the floating block, and the floating block is movably articulated with the middle portion of the operating lever.

2. The anti-loose socket according to claim 1, wherein the housing is composed of an upper lid body and a lower lid body snapped with each other.

3. The anti-loose socket according to claim 2, wherein in the pull-out locking mechanism, two cylinders are arranged in a symmetrical manner at two sides within the bevelled sleeve.

4. The anti-loose socket according to claim 2, wherein the anti-loose socket comprises more than one set of the pull-out locking mechanisms.

5. The anti-loose socket according to claim 1, wherein the cylinder is replaced by a wedge or sphere.

6. The anti-loose socket according to claim 1, wherein the pull-out locking mechanism, the inserting bushing, the spring or elastic body, and the floating block are mounted within a module base and a small panel having various inserting holes snapped with each other, so as to compose an anti-loose functional module.

7. The anti-loose socket according to claim 1, wherein a bracket is disposed between the bevelled sleeve and the inserting bushing, for securing the bevelled sleeve and the inserting bushing.

8. The anti-loose socket according to claim 1, wherein the pull-out locking mechanism is included in the anti-loose functional module, the anti-loose functional module further comprises a module base, and an upper small panel, the small panel and the module base are snapped with each other, an inserting bushing is mounted within the module base, for clipping the plug, the floating block is disposed between the small panel and the module base, a spring is mounted below the floating block; the bevelled sleeve for the plug to pass through is mounted at an inserting hole position corresponding to the small panel, an operating lever is mounted within the anti-loose socket, the middle portion of the operating lever is connected to the floating block, the floating block provides a tension force for the operating lever by means of the spring force of the spring, so that the operating lever closely fits the module base, and one of the two ends of the operating lever can contact with the module base to form a fulcrum, for rotating the other end under an external force.

* * * * *